US006513735B1

(12) United States Patent
Clark

(10) Patent No.: US 6,513,735 B1
(45) Date of Patent: Feb. 4, 2003

(54) SHOWERHEAD WITH TEXTURED WATER DISTRIBUTION SURFACE

(75) Inventor: Frank Clark, P.O. Box 205, Costilla, NM (US) 87524

(73) Assignee: Frank Clark, Costilla, NM (US)

( * ) Notice: Subject to any disclaimer, the term of this patent is extended or adjusted under 35 U.S.C. 154(b) by 0 days.

(21) Appl. No.: 09/929,248

(22) Filed: Aug. 13, 2001

(51) Int. Cl.[7] ..... B05B 15/00; B05B 1/14

(52) U.S. Cl. ..... 239/542; 239/548; 239/145; 239/326

(58) Field of Search ..... 239/145, 326, 239/542, 548

(56) References Cited

U.S. PATENT DOCUMENTS

| | | | | | |
|---|---|---|---|---|---|
| 757,791 | A | * | 4/1904 | Van't Woud | 401/28 |
| 816,924 | A | * | 4/1906 | Lattin | 401/28 |
| 1,404,700 | A | * | 1/1922 | Hardie | 239/542 |
| 1,969,042 | A | * | 8/1934 | Senn | 15/188 |
| 2,480,023 | A | * | 8/1949 | Holden | 401/28 |
| 2,515,600 | A | * | 7/1950 | Hayes | 239/542 |
| 3,797,738 | A | * | 3/1974 | Fitzhugh | 239/542 |
| 4,640,462 | A | * | 2/1987 | Stearns, III | 239/145 |
| 4,948,295 | A | * | 8/1990 | Pramsoler | 239/542 |
| 5,187,827 | A | * | 2/1993 | Wei | 15/22.1 |
| 5,249,325 | A | * | 10/1993 | Wilen | 15/118 |
| 5,893,836 | A | * | 4/1999 | Raines | 601/155 |
| 6,116,524 | A | * | 9/2000 | Zapalac | 239/548 |
| 6,382,531 | B1 | * | 5/2002 | Tracy | 239/104 |

FOREIGN PATENT DOCUMENTS

| | | | | | |
|---|---|---|---|---|---|
| JP | 2001186995 | A | * | 7/2001 | A47K/3/28 |

* cited by examiner

*Primary Examiner*—Robin O. Evans
(74) *Attorney, Agent, or Firm*—Gray Cary Ware & Freidenrich

(57) ABSTRACT

A showerhead according to the present invention includes a housing, a baffle located within the housing, a fluid-permeable absorbent element, and a fluid distribution element. The baffle and the upper lid of the housing define a fluid chamber that receives fluid from a fluid inlet. The fluid flows through seep holes in the baffle and into a second fluid chamber that contains the absorbent element. The fluid distribution element encloses the absorbent element within the second fluid chamber. The fluid distribution element includes a plurality of holes and a plurality of protrusions configured to release fluid from the second fluid chamber.

13 Claims, 4 Drawing Sheets

SHOWERHEAD WITH TEXTURED WATER DISTRIBUTION SURFACE

FIELD OF THE INVENTION

The present invention relates generally to shower fixtures. More particularly, the present invention relates to a showerhead.

BACKGROUND OF THE INVENTION

The prior art is replete with showerhead designs. Conventional showerheads utilize unmodified free flow water pressure to generate a spray of water. Water exiting a traditional showerhead is sent in a single direction by the force of the water pressure created in the supply plumbing. Such systems tend to consume a substantial amount of fresh water, most of which is wasted. Furthermore, most known showerheads produce a relatively narrow shower of water rather than distributing the water over a wide area. Such narrowly focused showerheads do not produce an effective stream of water that efficiently provides a wide area of water coverage to the person taking the shower.

BRIEF SUMMARY OF THE INVENTION

A showerhead according to the present invention produces an efficient and effective shower of water in a manner that conserves water. In contrast to many prior art designs, the showerhead distributes water over a relatively wide area without relying on wasteful free flow water pressure obtained directly from the supply plumbing.

Certain aspects of the present invention may be carried out in one form by a showerhead including a housing having a fluid inlet; a baffle located within the housing, the baffle having a first side, a second side, and a plurality of fluid seep holes, where the first side and at least a portion of the housing define a fluid chamber; and a fluid distribution element enclosing the baffle within the housing. The fluid distribution element is configured to release fluid obtained from the fluid seep holes.

BRIEF DESCRIPTION OF THE DRAWINGS

A more complete understanding of the present invention may be derived by referring to the detailed description and claims when considered in conjunction with the following Figures, wherein like reference numbers refer to similar elements throughout the Figures.

DETAILED DESCRIPTION OF A PREFERRED EMBODIMENT

Figure 1:
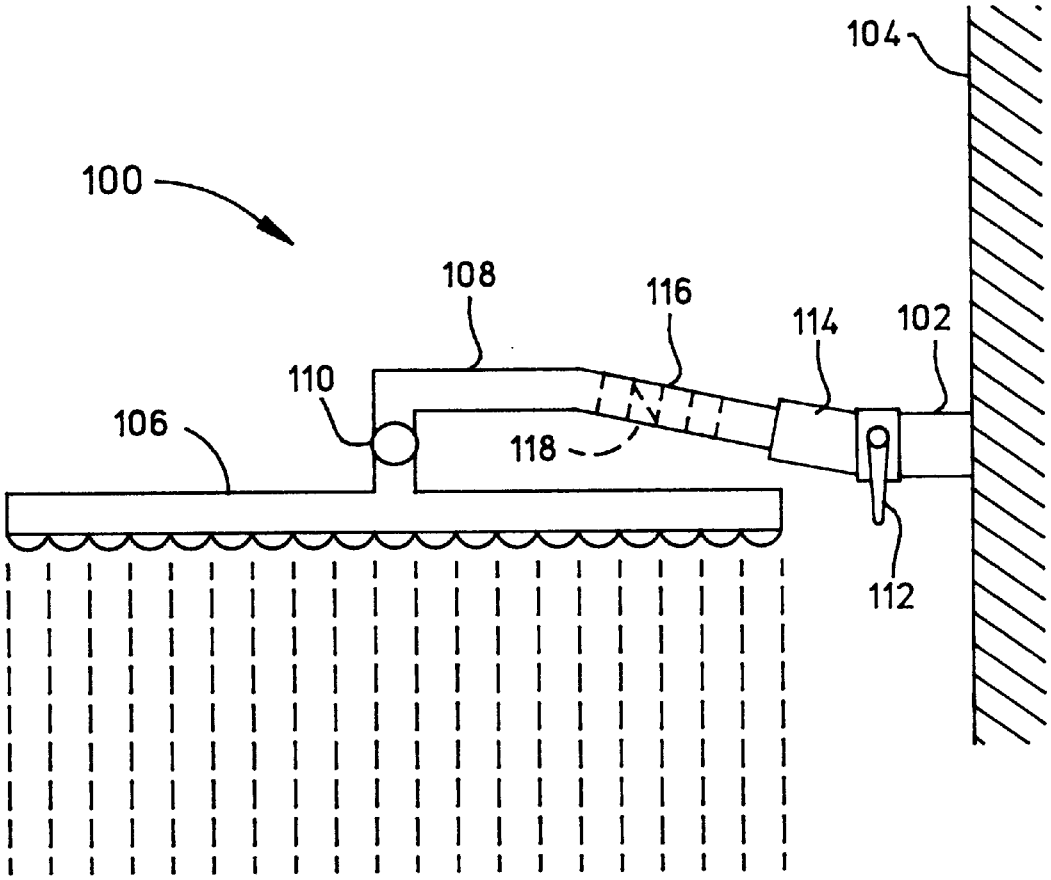
FIG. 1 is a side view of a shower fixture assembly in operation.

FIG. 1 depicts a shower fixture assembly 100 in operation. In most conventional applications, shower fixture assembly 100 is attached to a plumbing feature, e.g., a water pipe 102, that protrudes from a wall 104. Of course, shower fixture assembly 100 may be installed in any number of alternate mounting configurations. Shower fixture assembly 100 includes a showerhead 106 configured in accordance with the present invention. Showerhead 106 is connected to water pipe 102 via a suitable conduit 108, which may include one or more interconnected pipes, hoses, or the like. As shown in FIG. 1, showerhead 106 may be connected to a first end of conduit 108 via an adjustable joint 110, such as a swivel joint, a telescoping joint, a ball joint, or a rotating joint. Joint 110 allows the user to adjust the position of showerhead 106 and, consequently, the direction of the exiting water flow. Although not a requirement of the present invention, shower fixture assembly 100 may include a flow valve 112 for controlling the flow of fluid entering shower fixture assembly 100. Flow valve 112 may be utilized in conjunction with existing hot and cold water valves (or a combined hot and cold water regulator) to provide an added measure of water flow control.

Shower fixture assembly 100 may include an integral soap dispenser 114 that allows the user to dispense liquid soap and/or soap suds from showerhead 106. For example, soap dispenser 114 may be located between flow valve 112 and conduit 108. Conduit 108 may include a soap mixing chamber 116 for mixing soap with incoming water. In operation, soap dispenser 114 is filled or charged (with, for example, a liquid soap product) with flow valve 112 in the closed position. When flow valve 112 is opened, the soap from soap dispenser 114 is mixed with water from water pipe 102. Mixing chamber 116 may contain a number of in-line perforated baffles 118 (shown in dashed lines) that function to thoroughly mix the soap and water, resulting in an even frothing of suds and a full utilization of the soap product. The perforated baffles 118 may be angled with respect to the axis of mixing chamber 116 to promote efficient and uniform mixing of the soap and water. The soap suds and any remaining soap product can be purged from shower fixture assembly 100 by moving flow valve 112 to the fully opened position.

Although FIG. 1 depicts a top-mounted showerhead 106, the present invention is not so limited. Indeed, the features described below can also be extended for use in connection with a side-mounted showerhead and with other configurations and arrangements that may not be specifically addressed herein.

Figure 2:
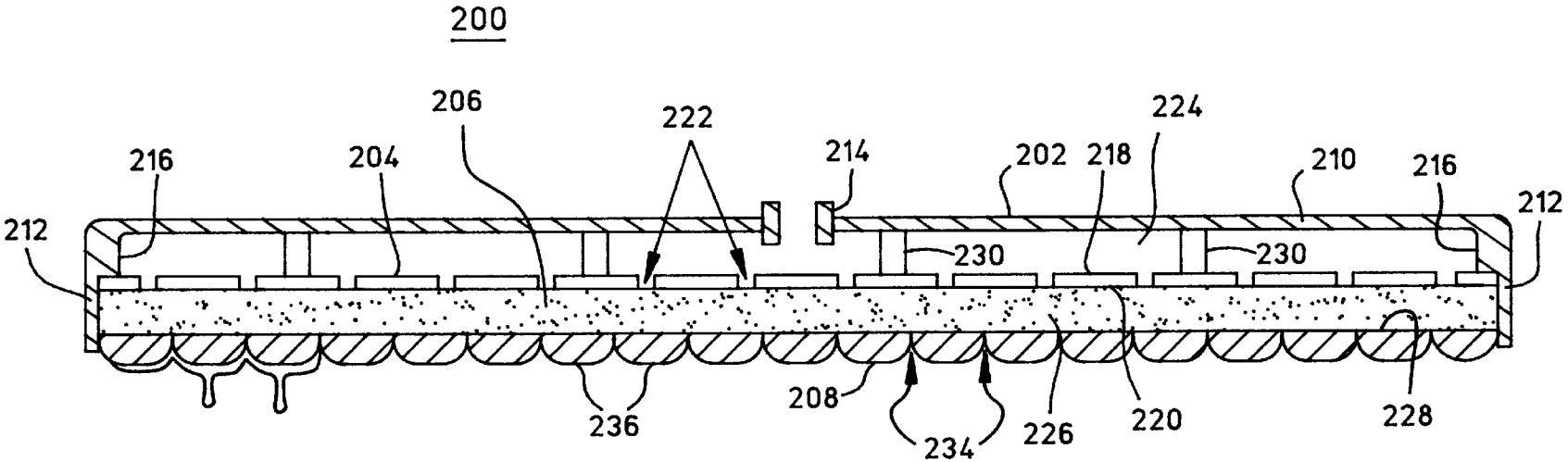
FIG. 2 is a cross sectional view of a showerhead.
Figure 3:
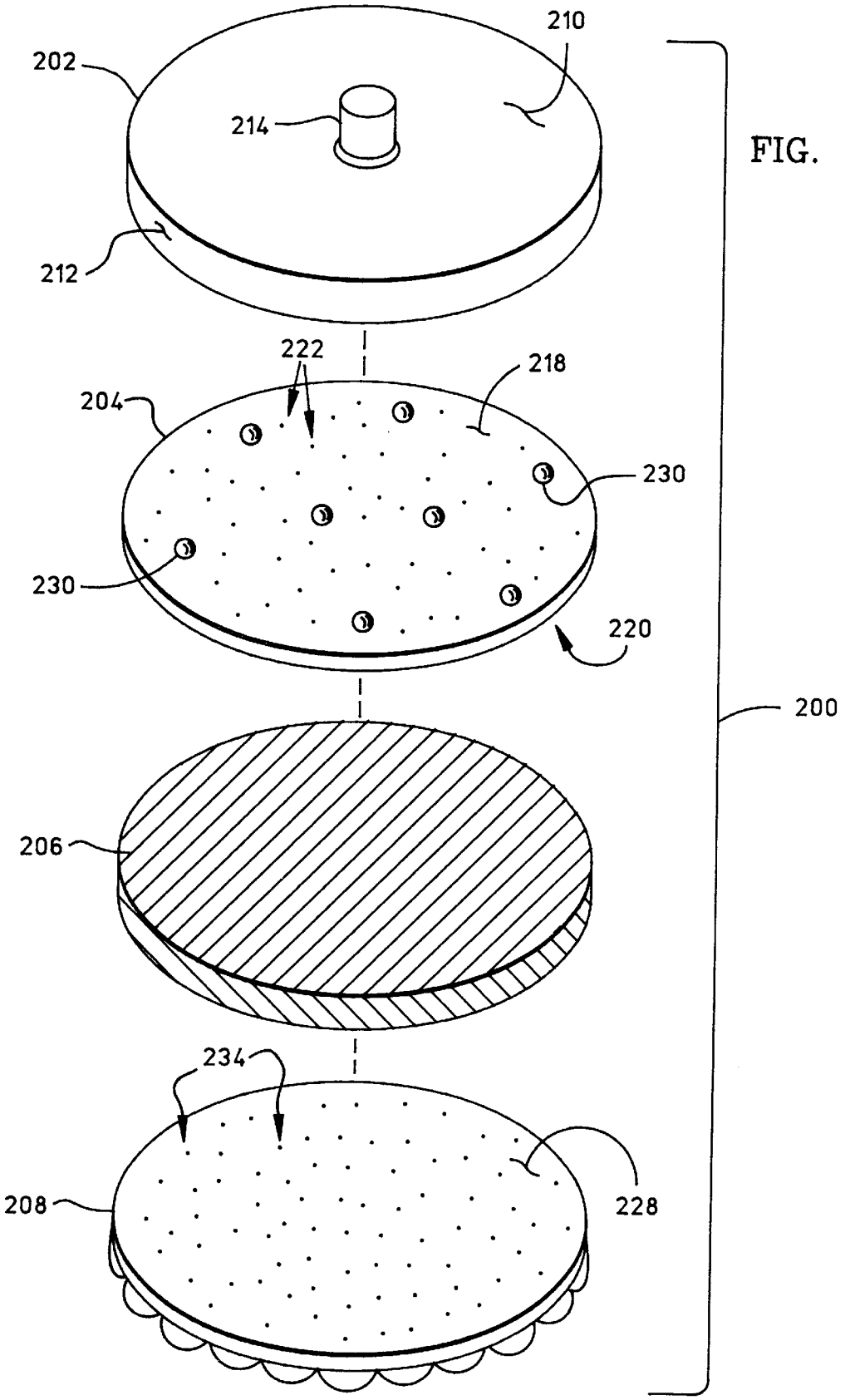
FIG. 3 is an exploded perspective view of a showerhead.

FIG. 2 is a cross sectional view of a showerhead 200 according to the present invention, and FIG. 3 is an exploded perspective view of showerhead 200. The cross sectional view of FIG. 2 corresponds to a vertical plane through the center of showerhead 200. Although FIGS. 2 and 3 depict a round showerhead, the present invention is not limited to any specific shape or size. Showerhead 200 generally includes a housing 202, a baffle 204, an absorbent element 206, and a fluid distribution element 208. Each of these components is described in more detail below.

Housing 202 provides the structural foundation for showerhead 200. Housing 202 can be formed from stainless steel, aluminum, plastic, or any suitable material. Housing 202 includes an upper lid 210 and a perimeter sidewall 212 extending from upper lid 210. Although not a requirement of the present invention, upper lid 210 and sidewall 212 may be integrally formed as a one-piece unit. In the illustrated embodiment, housing 202 is circular in shape and its height is substantially less than its diameter. For example, a housing 202 suitable for a practical application may have a diameter of 12 inches, a one-half inch height, and a one-eighth inch wall thickness. Housing 202 includes a fluid inlet 214 formed therein for receiving fluid such as water. In practical applications, fluid inlet 214 is coupled to a joint, a conduit, a pipe, or a suitable fixture that provides water to showerhead 202 (see, for example, shower fixture assembly 100). The size, shape, and/or location of fluid inlet 214 on showerhead 200 may vary from unit to unit depending upon the desired fluid flow characteristics, fluid chamber size, back pressure specifications, showerhead size, and other practical considerations.

Baffle 204 is formed from a substantially rigid material such as stainless steel, aluminum, or plastic. In the example embodiment, baffle 204 is approximately one-sixteenth of an inch thick, baffle 204 is located within housing 202, and housing 202 includes structure for positioning baffle 204 in the desired mounting location. For example, housing 202 may include an interior shoulder 216 formed within and around sidewall 212. Alternatively, housing 202 may include a number of discontinuous interior positioning tabs formed within and around sidewall 212. In a practical embodiment, baffle 204 is attached to housing 202 using a suitable mounting technique, e.g., welding, screws, adhesive, or the like. Alternatively, baffle 204 may be simply held in place by absorbent element 206 and/or fluid distribution element 208 (i.e., showerhead 200 may employ a sandwich construction technique).

Figure 4:
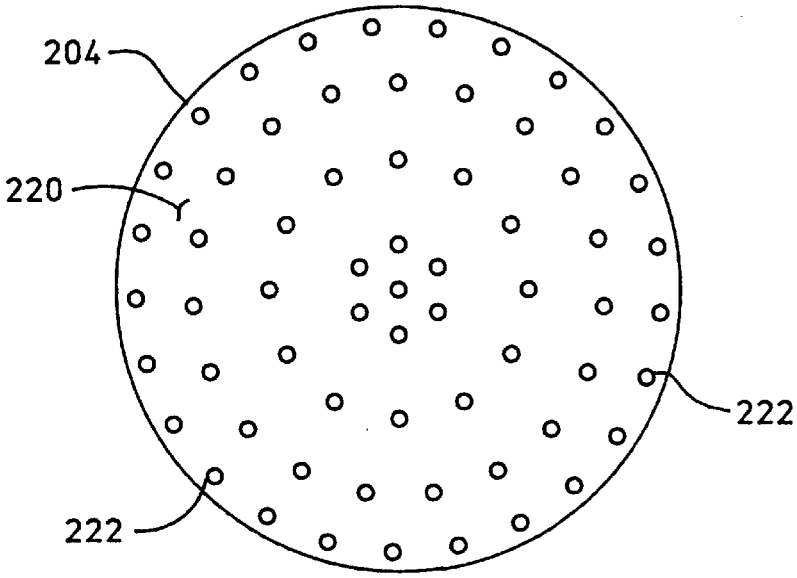
FIG. 4 is a bottom view of the baffle shown in FIG. 3.

With additional reference to FIG. 4, baffle 204 includes a first side 218, a second side 220 opposing first side 218, and a plurality of seep holes 222 formed therein. When baffle 204 is installed in housing 202, first side 218 is oriented upward and second side 220 is oriented downward. First side 218 and at least a portion of housing 202 (e.g., upper lid 210 and a portion of sidewall 212) define a fluid chamber 224 configured to receive fluid from fluid inlet 214. In the example embodiment, fluid chamber 224 is contained within housing 202. Housing 202 and baffle 204 are sized and shaped such that fluid chamber 224 is relatively flat and thin. This configuration allows fluid chamber 224 to be quickly filled and pressurized with fluid. In addition, the relatively low volume defined by fluid chamber 224 ensures that water is conserved during operation of showerhead 200. In accordance with one practical example, fluid chamber 224 resembles a cylinder having a 12 inch diameter and a one-eighth inch height.

Seep holes 222 allow the back pressurized fluid contained in fluid chamber 224 to seep into a second fluid chamber 226 defined by second side 220 of baffle 204, an inner surface 228 of fluid distribution element 208, and portions of sidewall 212. In accordance with one practical example, seep holes 222 are drilled into baffle 204 to a diameter between approximately one-sixteenth to approximately one-eighth inch. Of course, seep holes 222 need not be uniform in size or shape, and baffle 204 may include any combination of different seep hole configurations. For example, seep holes 222 may be realized as round holes, elongated slits, cracks, or the like.

Seep holes 222 may be suitably configured in a pattern that generates a dispersed fluid flow over an area of baffle 204. For example, seep holes 222 may be uniformly positioned over the entire surface of baffle 204. Alternatively, a number of seep holes 222 may be concentrated in specific areas of baffle 204, e.g., near the center or near the edge of baffle 204. Furthermore, the size of seep holes 222 may vary depending upon their location on baffle 204. For example, larger diameter seep holes can be located near the outer perimeter of baffle 204, and smaller diameter seep holes can be located near the center of baffle 204. The location of seep holes 222 in baffle 204 may vary depending upon the size of showerhead 200, the anticipated water pressure provided by the existing plumbing, the size of fluid inlet 214, the volume defined by fluid chamber 224, the specific configuration of fluid distribution element 208, and other practical considerations. Preferably, seep holes 222 are patterned such that the fluid passes into second fluid chamber 226 at a substantially constant flow rate and in an evenly distributed manner.

Showerhead 200 may include a number of baffle offsets 230 located between baffle 204 and upper lid 210 of housing 202. Baffle offsets 230 may be realized as small blocks, spherical balls, or the like. In one practical embodiment, baffle offsets 230 are attached to first side 218 of baffle 204 such that, when baffle 204 is installed in housing 202, baffle offsets 230 contact upper lid 210. Baffle offsets 230 reduce flexing of baffle 204 and maintain the integrity of first fluid chamber 224. The relatively small and unobtrusive size of the baffle offsets 230 allows fluid to flow between and around baffle offsets 230 without adversely affecting the seepage from fluid chamber 224 to fluid chamber 226.

Fluid distribution element 208 is attached to housing 202 such that it forms a lower lid that encloses baffle 204 within housing 202. A practical embodiment utilizes a stainless steel fluid distribution element 208 that is welded to housing 202. As described above, second fluid chamber 226 is defined in part by inner surface 228 of fluid distribution element 208. In accordance with an example embodiment, second fluid chamber 226 is larger than fluid chamber 224; second fluid chamber 226 resembles a cylinder having a diameter of 12 inches and a one-quarter inch height.

Absorbent element 206 is suitably positioned within second fluid chamber 226. In the illustrated embodiment, absorbent element 206 substantially fills second fluid chamber 226. In this regard, absorbent element 206 is positioned between second side 220 of baffle 204 and inner surface 228 of fluid distribution element 208. Absorbent element 206 is suitably configured to fluidly couple fluid chamber 224 to fluid distribution element 208. Absorbent element 206 is formed from a fluid-permeable material that allows fluid to be transported from seep holes 222 to fluid distribution element 208.

In a practical embodiment, absorbent element 206 is formed from a suitable material that does not retain a significant amount of fluid after showerhead 200 is depressurized. In other words, a suitable absorbent element 206 would be self-draining to reduce the likelihood of corrosion, mildew, and mold. Although not a requirement of the present invention, absorbent element 206 is substantially uniform in composition throughout second fluid chamber 226. Such uniformity ensures that fluid is discharged from absorbent element 206 in a consistent and even manner. In one practical embodiment, absorbent element 206 is formed from a solid, porous, and dense material.

Absorbent element 206 may be formed from any of the following materials, alone or in combination: foam; nylon webbing; stainless steel mesh; perforated rubber; natural or synthetic sponge; or the like. Absorbent element 206 may be held in place by fluid distribution element 208, or it may be attached to baffle 204, housing 202 and/or fluid distribution element 208. Absorbent element 206 may be fabricated as an individual component or it may be deposited or injected into showerhead 200 during assembly.

Figure 6:
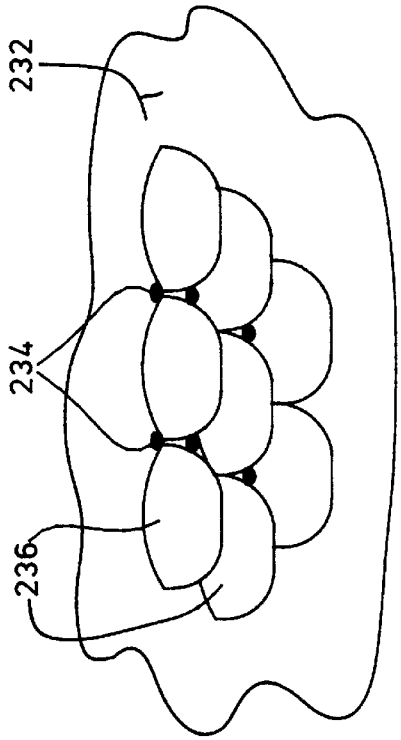
FIG. 6 is a perspective view of a detailed portion of a fluid distribution element.
Figure 5:
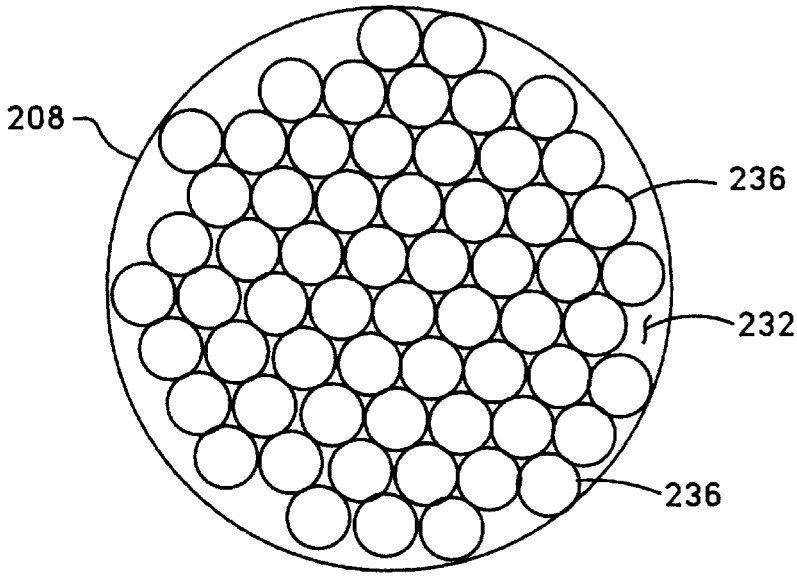
FIG. 5 is a bottom view of the fluid distribution element shown in FIG. 3.

FIG. 5 is a bottom view of fluid distribution element 208 and FIG. 6 is a perspective view of a detailed portion of fluid distribution element 208. In a practical embodiment, fluid distribution element 208 is formed from a suitable material such as stainless steel, aluminum, plastic, or the like. Briefly, fluid distribution element 208 is suitably configured to release fluid obtained from seep holes 222 via absorbent element 206. In this regard, fluid distribution element 208 is fluidly coupled to fluid chamber 224 via seep holes 222, second fluid chamber 226, and absorbent element 206.

Fluid distribution element 208 includes at least one fluid release surface 232, a plurality of fluid distribution holes 234 formed within fluid distribution element 208, and a plurality of protrusions 236 extending beyond fluid release surface 232. Fluid distribution element 208 may be a unitary component that defines protrusions 236, or it may be a combination of a lid (or a plate) having any number of attached elements that serve as protrusions 236. In this regard, protrusions 236 provide a texturized outer surface for fluid distribution element 208. In one practical embodiment, fluid distribution holes 234 terminate at fluid release surface 232. In lieu of (or in addition to) fluid distribution holes 234, fluid distribution element 208 may be formed from a porous or fluid permeable material that facilitates fluid transfer from second fluid chamber 226.

In the normal operating orientation, water is released at a relative high point, corresponding to fluid release surface 232, before traveling down protrusions 236. Eventually, the water drops from the relative low points defined by protrusions 236. As shown in FIG. 6, fluid distribution holes 234 may be located between protrusions 236 such that fluid quickly flows onto protrusions 236.

Protrusions 236 can be sized, shaped, arranged, and otherwise configured to transport fluid away from fluid release surface 232. For example, protrusions 236 can be dome-shaped, pointed, rod-shaped, or the like. Although not a requirement of the present invention, protrusions 236 may be substantially uniform in size and/or substantially uniform in shape. In accordance with one example embodiment, each protrusion 236 is a round bump having a diameter of approximately one-quarter inch and having a height of approximately three-sixteenths of an inch. A number of round holes may be drilled into fluid distribution element 208 to serve as fluid distribution holes 234. In a practical embodiment, fluid distribution holes 234 can have a diameter between approximately one-thirty-second inch and one-eighth inch. Of course, fluid distribution element 208 may include fluid distribution holes 234 of different shapes and sizes.

The creation of a substantially uniform and distributed back pressure of fluid within second fluid chamber 236, in conjunction with the configuration of fluid distribution element 208, facilitates the even release of fluid droplets across the face of showerhead 200. Relying upon the surface tension of the fluid, the high and low portions of fluid distribution element 208 create "fluid highways" that transport the fluid from holes 234 located above the textured drip point on the face of fluid distribution element 208. The result is the formation of a droplet as the fluid travels from holes 234 to the lower points defined by the ends of protrusions 236. The drops are forced in a relatively slow manner from the face of fluid distribution element 208 by both gravity and by continuing seepage from second fluid chamber 226. This surface tension effect and the formation of droplets is depicted at the left side of FIG. 2. Notably, the droplet size can vary depending upon the specific texturing of fluid distribution element 208. For instance, larger "bumps" or texturing can generate larger droplets, and smaller "bumps" or texturing can generate smaller droplets. Generally, the size and shape of each "bump" in the texture pattern can be designed such that it retains more or less water before releasing the droplet. In this regard, certain sections of fluid distribution element 208 can generate relatively small droplets while other sections of fluid distribution element 208 can generate relatively large droplets.

In summary, a showerhead according to the present invention produces and releases individual droplets of water using a small amount of water in comparison to traditional showerheads that generate a spray or a stream of water. A relatively small amount of water is distributed over a large area defined by the fluid distribution element. The user experiences a different sensation when the droplets (rather than a spray of water) are released over the wide area. In this regard, the showerhead conserves water while using a new technique for generating and distributing water droplets.

The present invention has been described above with reference to a preferred embodiment. However, those skilled in the art having read this disclosure will recognize that changes and modifications may be made to the preferred embodiment without departing from the scope of the present invention. These and other changes or modifications are intended to be included within the scope of the present invention, as expressed in the following claims.

What is claimed is:

1. A showerhead comprising:

a housing having a fluid inlet;

a baffle located within said housing, said baffle having a first side, a second side opposing said first side, and a plurality of fluid seep holes formed therein, said first side and at least a portion of said housing defining a fluid chamber configured to receive fluid from said fluid inlet;

a fluid distribution element enclosing said baffle within said housing, said fluid distribution element comprising:

a fluid release surface;

a plurality of fluid distribution holes formed within said fluid distribution element and terminating at said fluid release surface; and a plurality of protrusions extending beyond said fluid release surface, said plurality of protrusions being configured to release fluid obtained from said plurality of fluid seep holes; and an absorbent, fluid-permeable element positioned between said second side and said fluid distribution element.

2. A showerhead according to claim 1, wherein said plurality of fluid distribution holes are located between said plurality of protrusions.

3. A showerhead according to claim 1, wherein:

said second side and an inner surface of said fluid distribution element define a second fluid chamber; and said fluid-permeable element substantially fills said second fluid chamber.

4. A showerhead according to claim 1, wherein said plurality of seep holes are configured in a pattern that generates a dispersed fluid flow over an area of said baffle.

5. A showerhead comprising:

a housing having a fluid inlet;

a fluid chamber within said housing, said fluid chamber being configured to receive fluid from said fluid inlet;

a fluid distribution element fluidly coupled to said fluid chamber, said fluid distribution element being configured to release fluid obtained from said fluid chamber, said fluid distribution element comprising:

a fluid release surface;

a plurality of fluid distribution holes formed within said fluid distribution element and terminating at said fluid release surface; and a plurality of protrusions extending beyond said fluid release surface; wherein said plurality of fluid distribution holes are configured to release fluid at said fluid release surface; and said plurality of protrusions are configured to transport fluid away from said fluid release surface;

a baffle having a first side, a second side opposing said first side, and a plurality of fluid seep holes formed therein, said first side and at least a portion of said housing defining said fluid chamber; and an absorbent, fluid-permeable element positioned between said second side and said fluid distribution element, said fluid-permeable element being configured to fluidly couple said fluid chamber to said fluid distribution element.

6. A showerhead according to claim 5, wherein said plurality of protrusions are substantially uniform in shape.

7. A showerhead according to claim 6, wherein said plurality of protrusions are substantially uniform in size.

8. A showerhead according to claim 5, wherein said plurality of fluid distribution holes are located between said plurality of protrusions.

9. A showerhead according to claim 5, wherein said fluid distribution element encloses said baffle within said housing.

10. A showerhead comprising:

a housing having a fluid inlet;

a fluid chamber within said housing, said fluid chamber being configured to receive fluid from said fluid inlet; and a fluid distribution element fluidly coupled to said fluid chamber, said fluid distribution element comprising:

a textured surface configured to form and release droplets of fluid obtained from said fluid chamber;

a fluid release surface;

a plurality of fluid distribution holes formed within said fluid distribution element and configured to release fluid onto said textured surface; and a plurality of protrusions extending beyond said fluid release surface, said plurality of protrusions forming said textured surface, said plurality of protrusions being configured to transport droplets of fluid away from said fluid release surface, wherein surface tension of said plurality of protrusions facilitates formation of said droplets on said textured surface.

11. A showerhead according to claim 10, wherein said textured surface is configured to form said droplets as fluid travels from said plurality of fluid distribution holes to said plurality of protrusions.

12. A showerhead according to claim 10, wherein seepage of fluid from said fluid chamber to said fluid distribution element, combined with gravitational force, facilitates formation of said droplets on said textured surface.

13. A showerhead according to claim 12, wherein seepage of fluid from said fluid chamber to said fluid distribution element, combined with gravitational force, causes said droplets to be released from said textured surface.

* * * * *